US006108815A

United States Patent [19]

Majerfeld

[11] Patent Number: 6,108,815

[45] Date of Patent: Aug. 29, 2000

[54] JACKET WITH DROP DOWN PANTS

[76] Inventor: Eddie Majerfeld, 2350 St-Louis, St-Laurent, Quebec, Canada, H4M 1P5

[21] Appl. No.: 09/189,174

[22] Filed: Nov. 10, 1998

Related U.S. Application Data

[60] Provisional application No. 60/064,770, Nov. 10, 1997.

[51] Int. Cl.[7] ..... A41B 1/12; A41D 1/06; A41D 13/02; A41D 27/20; A41D 1/12

[52] U.S. Cl. ..... 2/71; 2/79; 2/247

[58] Field of Search ..... 2/71, 72, 70, 94, 2/114, 86, 79, 76, 247, 250

[56] References Cited

U.S. PATENT DOCUMENTS

| | | | |
|---|---|---|---|
| 1,072,776 | 9/1913 | Routery . | |
| 1,596,085 | 8/1926 | Downes . | |
| 1,664,309 | 3/1928 | Mueller . | |
| 1,772,298 | 8/1930 | Werber . | |
| 1,778,712 | 10/1930 | Botha . | |
| 1,783,505 | 12/1930 | Hayes . | |
| 1,825,197 | 9/1931 | McGinnis . | |
| 2,073,485 | 3/1937 | Knowling . | |
| 2,279,125 | 4/1942 | Mintzes . | |
| 2,297,117 | 9/1942 | Weinberg . | |
| 2,308,929 | 1/1943 | Mintzes . | |
| 2,472,141 | 6/1949 | Botha . | |
| 2,959,788 | 11/1960 | Justad . | |
| 3,147,491 | 9/1964 | Fisch . | |
| 4,158,892 | 6/1979 | Gonzales . | |
| 4,390,996 | 7/1983 | Read | 2/70 |
| 4,485,493 | 12/1984 | Leinoff | 2/86 |
| 4,663,781 | 5/1987 | Krosby | 2/86 |
| 4,718,122 | 1/1988 | Steverson . | |
| 5,008,962 | 4/1991 | Smith et al. | 2/234 |
| 5,040,243 | 8/1991 | Tatsuno . | |
| 5,077,838 | 1/1992 | Senser . | |

*Primary Examiner*—John J. Calvert
*Assistant Examiner*—Shirra Jenkins
*Attorney, Agent, or Firm*—Rader, Fishman & Grauer PLLC

[57] ABSTRACT

A convertible garment comprises a jacket and optional pants. The pants which are attached at an upper end thereof to a lower end of the jacket include a pair of flexible leg panels each having adapted to be reversibly displaced between open and closed positions, wherein, in the closed position, each leg panel forms a hollow pant leg capable of surrounding a user's leg, whereas, when the leg panels are in the open position, the leg panels can be bundled up adjacent the lower end of the jacket in a storage position of the pants such that the garment only acts as a jacket. A pocket is formed on the inside of the lower end of the jacket to accommodate the pants in their storage position.

14 Claims, 3 Drawing Sheets

11
23
13
22
14
12
10
16
26
28
26b
26a,26b
26a
26b
20
24
24

JACKET WITH DROP DOWN PANTS

This application claims benefit of U.S. provisional application Ser. No. 60/064,770 filed Nov. 10, 1997.

BACKGROUND OF THE INVENTION

1. Field of the Invention

The present invention relates to the art of convertible garments and, more particularly, to a jacket and pants combination.

2. Description of the Prior Art

It is known in the art of clothing to have jackets and pants that may be attached together in order to provide better weather protection for the people's waist area. However, a person wearing the jacket has to put on the pants and then attach the same to the jacket with a zipper or snaps. This is usually irksome because the person has to take off his shoes, put on the pants and then put his shoes back on; or take the risk of dirtying the pants by slipping them on over the shoes. In a public place, such as on a ski slope, this process is even more uncomfortable and may even become embarrassing.

It is also known in the art of clothing to have pants which are not put on like conventional pants but which are rather attach with snaps around each leg. This is usually done by having the pants in the form of two panels that may be brought together like cylinder around the user's legs and then closed as such by attaching their sides together using a number of spaced apart snaps placed on facing lateral edges of the panels. However, such pants are sold apart from the jacket, as a physically stand alone garment. Thus, people had to carry on these pants separately from the jacket, in a little bag for example, in order that they be available upon the need to wear them appeared.

For instance, U.S. Pat. No. 5,040,243 issued on Aug. 20, 1991 to Tatsuno discloses a jacket having an external pocket on the outside of the jacket which contains a covering jacket to be worn in bad weather conditions. Since the pocket of this jacket is external, it opens rearwardly of the user. The optional jacket is ready-to-wear once removed from the external pocket in that it does not require any assembly.

U.S. Pat. No. 5,077,838 issued on Jan. 7, 1992 to Senser refers to a convertible outerwear garment similar to the previous one, except that the pocket containing the second jacket is internal. The pocket opens upwardly so it seems almost essential that the jacket be removed for allowing the second jacket to be pulled from the internal pocket.

U.S. Pat. No. 4,718,122 issued on Jan. 12, 1988 to Steverson discloses a coat which may be converted so as to assume any one of three different lengths (see FIGS. 3, 4 and 5). The coat bottom part comprises two panels which may be brought around the legs to form a pair of pants (see the coverall of FIG. 2) using buttons as fasteners. The legs in the intermediate raincoat length and short car length positions thereof are simply folded back inside the coat and attached thereto on its inside surface.

In U.S. Pat. No. 1,072,776, Routery discloses a jacket having a pair of pants integrally attached thereto. These pants are not intended to be retracted within the jacket at any time and the garment is put on by slipping the pants over the legs in a conventional manner and by then putting the arms through the sleeves of the jacket which is thereafter closed over the torso and fastened shut, as seen in FIG. 3.

As to U.S. Pat. No. 4,158,892 issued on Jun. 26, 1979 to Gonzales, it discloses a sleeping bag which converts to a jumpsuit, wherein at the level of the pants, the front panel sections 33 are secured at their outer edges to the rear panel sections 41. When used as a sleeping bag, the front sections 33 are secured together with zippers 34 as are the rear sections 41 with zippers 42, whereby the lower section 17 forms a large pouch; in the jumpsuit arrangement, each front section 33 is secured at its inner edge with a corresponding edge of a rear section 41 by way of cooperating zippers 34 and 42 thereby defining a pant leg (see FIG. 3). The pants are not retractable within the jacket and each pant leg requires two distinct and separate zippers.

SUMMARY OF THE INVENTION

It is therefore an object of the present invention to provide an all-in-one jacket and pants adapted such that the jacket carries the pants in their collapsed storage position while the pants may be deployed to their functional position such as to be worn, when so required, by the user.

It is a more specific object of the present invention to provide a jacket comprising built-in pants which, when packed-up in an easy-access internal pocket of the jacket, take the form of panels which may be easily rolled down from the jacket, assembled into leg pants and worn as pants attached to the jacket.

Therefore, the built-in pants may be rolled-down from the jacket's internal pocket when the weather, e.g. rain, wind, etc., suggests the use of pants, or that may be collapsed in a rolled up storage position, inside the jacket's internal pocket, thus giving the appearance of a conventional jacket. The jacket of the present invention comprises an inside pocket located all along the jacket's bottom part and, around the person's waist. The pocket can be selectively opened or closed, preferably by a zipper. When the person wearing the jacket needs extra weather protection for his legs, he may unzip the internal pocket and downwardly deploy therefrom a pair of pants bunched up in the pocket and then in the form of a pair of panels. Typically, the upper part of these pants is attached (such as with a seam) to the bottom part of the jacket so the jacket and the pants form a single garment. When the pants are rolled down, they have the aspect of two leg panels or open cylinders, having their upper extremities attached to the jacket. Each legs panel of the pants is brought around a respective leg of the user and its edges are attached together, e.g. by a zipper.

Preferably, the two leg panels are attached side-by-side together at upper inner portions thereof, at a level extending generally opposite between the wearer's waist and crotch, and are separate from each other therebelow. A crotch panel is provided as an upward continuation of the inner edges of the separated portions of both leg panels. The crotch panel can thus also be deployed from the internal pocket so as to be attached to upper outer portions of the leg panels when the leg panels are assembled into pants.

For wearing the jacket only, the person has to roll up the pants' legs, place them in the internal pocket of the jacket and zip up the pocket. Alternatively, the jacket may be held by a lower corner thereof and the zipper may be zipped up as the pants which hang from the jacket gradually become received in the pocket as it is being gradually closed by the zipper.

Therefore, in accordance with the present invention, there is provided a convertible garment, comprising jacket means and pants means attached at an upper end thereof to said jacket means, said pants means comprising a pair of flexible panel means each adapted to be reversibly displaced between open and closed positions thereof, wherein, in said closed position, each said panel means forms a hollow pant leg capable of surrounding a user's leg, wherein, when said panel means are in said open position, said panel means can be completely bundled up adjacent said upper end in a storage position of said pants means such that said garment only acts as a jacket, retention means being provided in said jacket means for retaining in said jacket said pants means in said storage position, whereby in said closed position of said panel means, said pants means act as pants for the user.

Also in accordance with the present invention, there is provided a convertible garment, comprising jacket means and flexible pants means attached at an upper end thereof to said jacket means, pocket means provided at a lower end of said jacket means, said pocket defining at least lower opening means adapted adopt at least partly open and closed positions thereof such that said pants means may be introduced in said pocket means through said opening means in said open position and stored and retained in said pocket mean when said opening means is in said closed position, wherein when said pants means are stored, said garment only acts as a jacket for a user of said garment, whereas when said pants means are deployed from said pocket means, said pants means act as pants for the user.

Further in accordance with the present invention, there is provided a method of converting a garment from a jacket to a jacket and pants combination, comprising the steps of:

a) providing jacket means and pants means attached at an upper end thereof to said jacket means, said jacket means having retention means for completely storing said pants means in a storage position of said pants means wherein said garment only functionally includes a jacket;

b) releasing said retention means for allowing said pants means to be deployed from said jacket means and to hang therefrom; and c) assembling said pants means into a pair of pants worn by the user with said jacket.

Still further in accordance with the present invention, there is provided a method of converting a garment from a jacket and pants combination to a jacket only, comprising the steps of:

a) providing jacket means and pants means attached at an upper end thereof to said jacket means, said pants means hanging from said jacket means, said jacket means and said pants means being worn by a user, said jacket means having retention means for completely storing said pants means in a storage position of said pants means;

b) removing said pants means from the user; and c) bundling up and storing said pants means in said retention means, whereby said garment only functionally includes a jacket.

BRIEF DESCRIPTION OF THE DRAWINGS

Having thus generally described the nature of the invention, reference will now be made to the accompanying drawings, showing by way of illustration a preferred embodiment thereof, and in which.

DESCRIPTION OF THE PREFERRED EMBODIMENTS

In the preferred embodiment of the present invention, there is provided a combined jacket and pants that provide each of use, comfort and very good weather protection, especially in the waist area. The invention also facilitates the manner in which a person puts on the pants, when needed. With the present invention, the pants may be deployed and assembled easily enough that this operation may be accomplished in a stand up position without having to remove the jacket and without the need of sitting down or standing on one foot only and without having to remove one's shoes.

Figure 1:
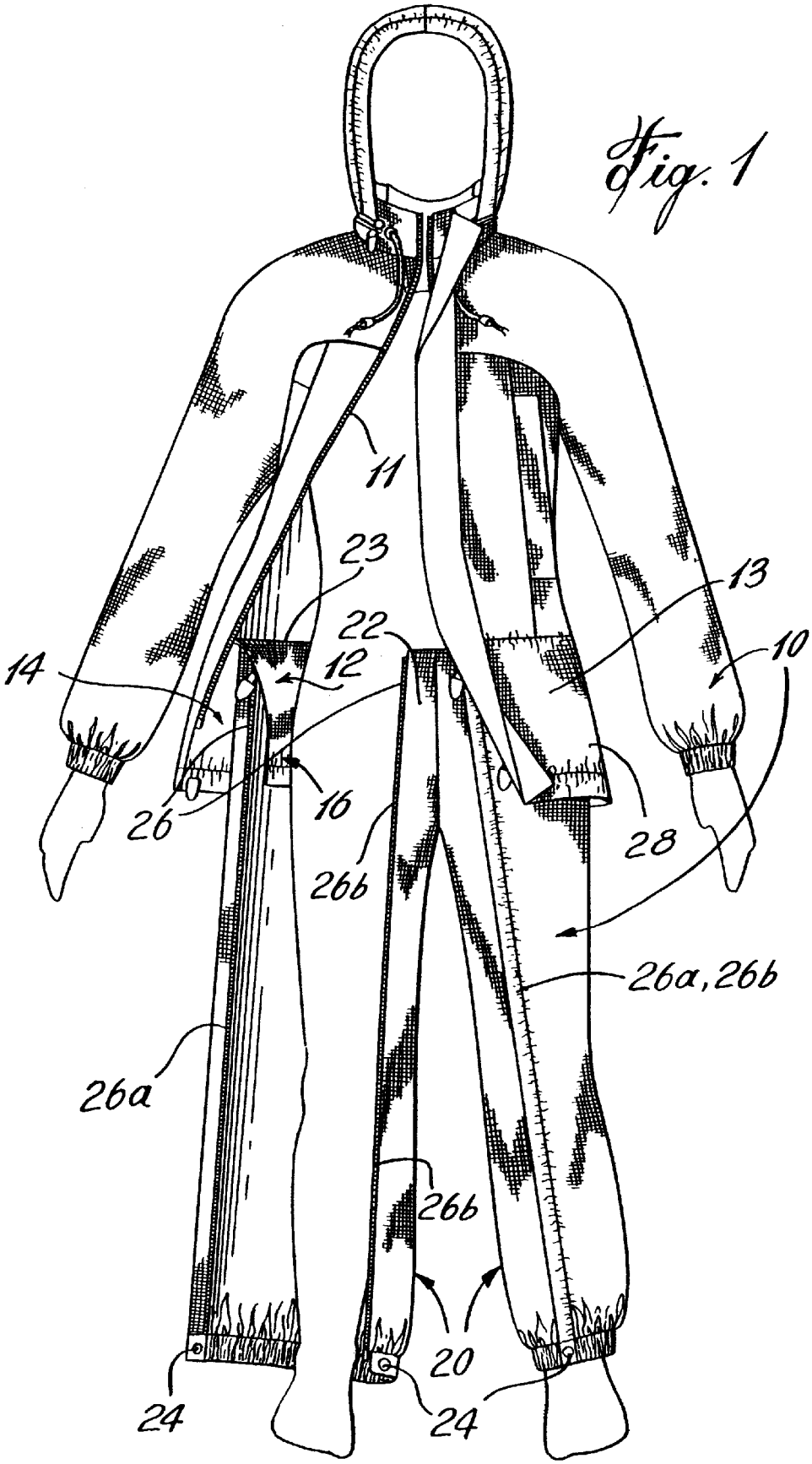
FIG. 1 is a schematic front elevational view of a jacket with the built-in pants in accordance with the present invention, where the pants are shown deployed and partially assembled.

Accordingly, the all-in-one jacket takes the form of a generally conventional jacket 10, as shown in FIG. 1, provided with a zipper 11 to close it. The jacket 10 is also different in its design in that it comprises an inside pocket 12 (which is better shown in FIG. 2) which extends along a lower end 13 of the jacket, on an inner side thereof, and which is adapted to contain a pair of pants 20 in their storage position (FIG. 3*b*).

The jacket's internal pocket 12 is composed of an outer skirt 14 which, in this embodiment, also corresponds to the outside lower end 13 of the jacket 10, an inner skirt 16 and a zipper 18 extending along lower edges of the inner and outer skirts 16 and 14. The zipper 18 has one part sewn to the outer skirt 14 and another part sewn to the inner skirt 16 such that the lower edges of both the skirts 14 and 16 may be selectively attached together. The upper edge of the inner skirt 16 is sewn to the main body of the jacket 10. The purpose of the zipper 18 is to close the lower end of the internal pocket 12. The sides of the pocket 12 are partly closed by a pair of snaps 19 (see FIG. 2).

Figure 2:
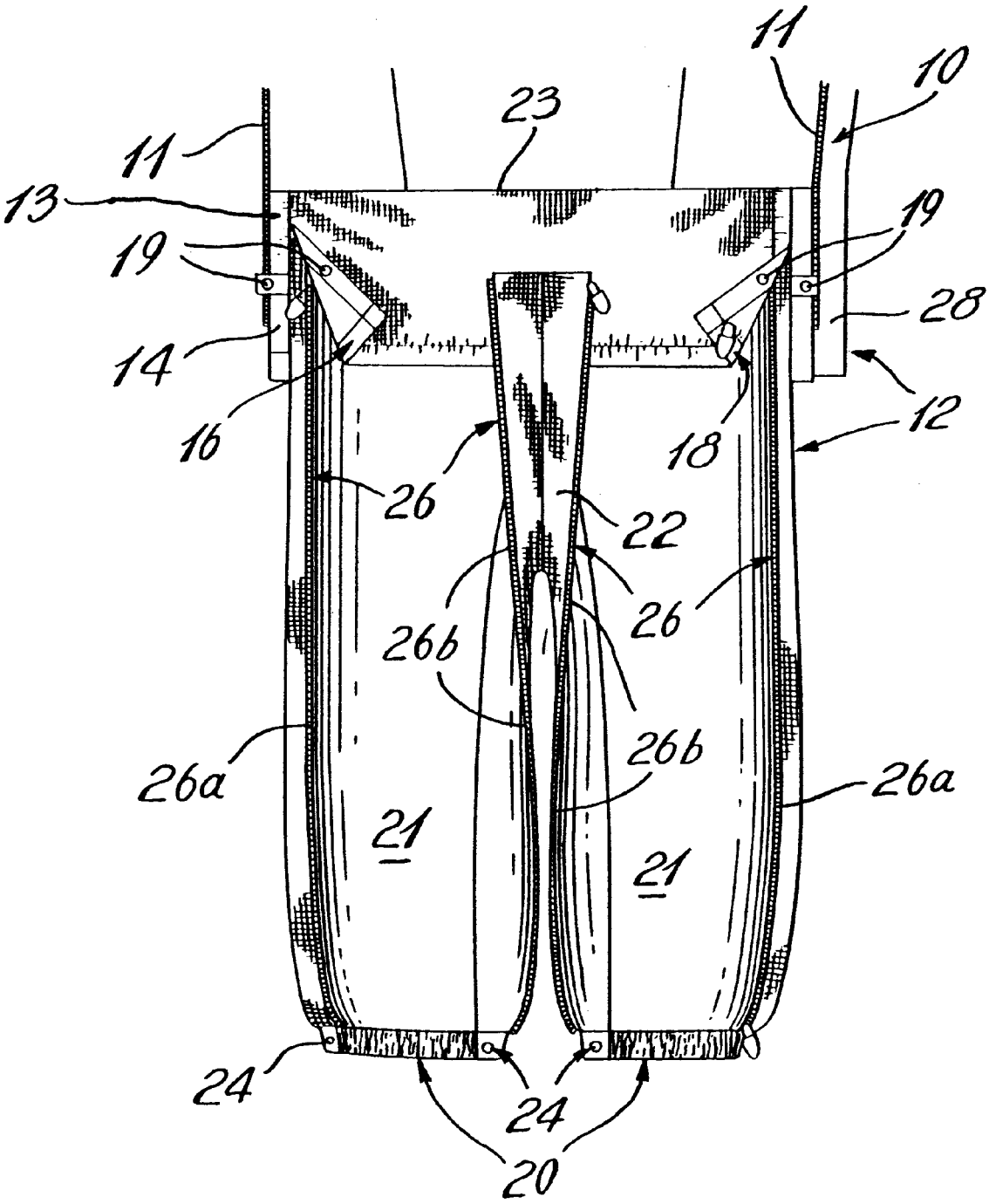
FIG. 2 is a schematic front elevational detailed view of the pants which are shown unobstructed by the jacket for illustration purposes and in an unassembled position thereof.
Figure 3A:
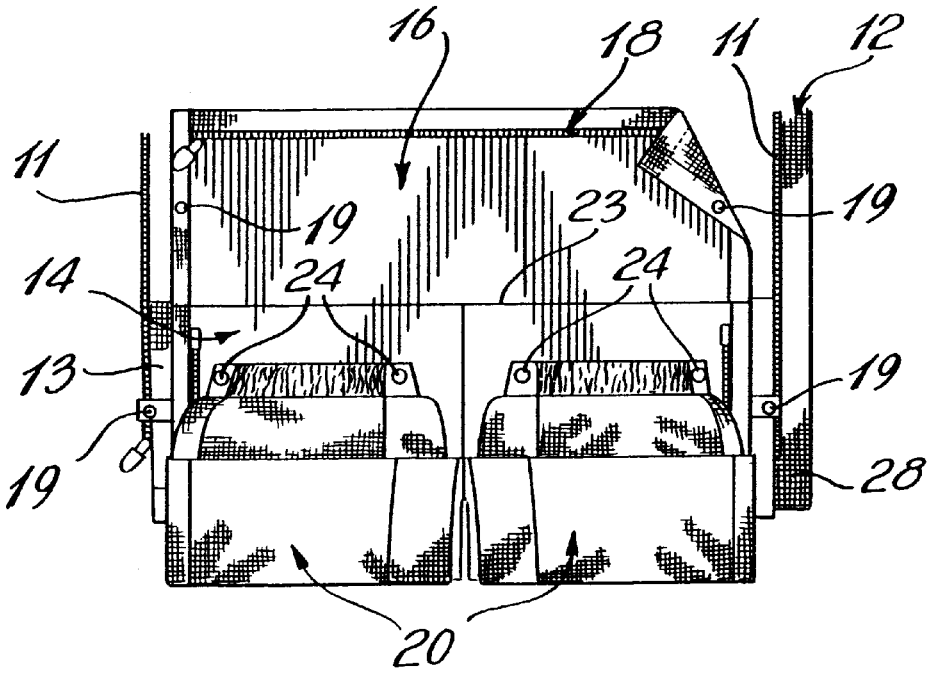
FIGS. 3*a* and 3*b* show schematic front elevational detailed views of the pants respectively in their rolled up position and packed in the jacket's internal pocket.
Figure 3B:
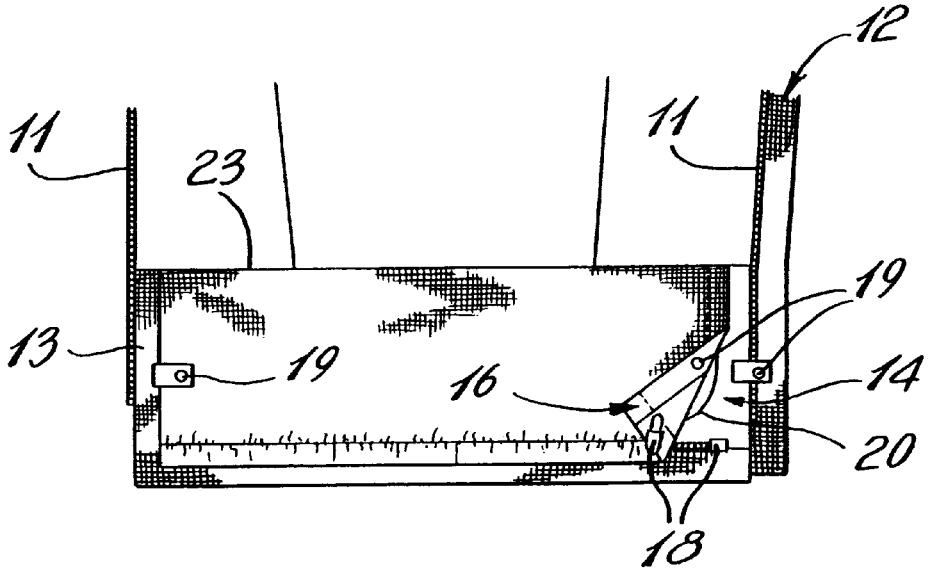

The jacket's internal pocket 12 comprises a pair of pants 20 which are attached at an upper end thereof to the jacket 10 by a seam (in the present case, the same seam 23 secures both the pants 20 and the inner skirt 16 to the outer skirt 14/lower end 13 of the jacket 10) and which, when collapsed, are packed up in a rolled up position, as shown in FIG. 3*b*, being located inside the pocket 12 and retained therein by the closed zipper 18 and the engaged snaps 19. In order to roll down or release the pants 20, a person wearing the jacket 10 has to unzip the zipper 18 and detach the snaps 19 such as to open the sides and the lower end of the internal pocket 12 and let the pants 20 drop down therefrom, as best shown in FIG. 2.

The pants 20 comprise two main panels 21 joined together at their upper portions and separated from each other therebelow, and a crotch portion or extension 22 extending between the panels 21 and protruding as an appendix from the upper portions thereof. Each panel 21 comprises a zipper 26 which includes a pair of cooperating zipper sections 26*a* and 26*b* secured respectively to the outer longitudinal edge of the panel 21, and to the inner longitudinal edge thereof and its extension along an outer edge of the crotch extension 22. At the bottom end of each panel 21, that is below the zipper sections 26*a* and 26*b*, there is provided a releasably engageable snap 24.

After the pants 20 have been deployed as in FIG. 2, the person has to pass the crotch extension 22 forwardly between his legs and upwardly thereafter in front of the his pelvis area and, then, each main panel 21 is brought around the leg such as to surround it like a conventional pant leg, whereat the opposed edges of the panel 21, as well as the crotch extension 22, are attached together by engaging the zipper portions 26*a* and 26*b* together, and each pants leg bottom snap 24 is then closed. The end result is shown in the left leg of the pants 20 of FIG. 1.

If the person wants to wear only the jacket 10, he/she has to disengage the snaps 24 and unzip the vertical zippers 26 thereby "undoing" the two cylinders forming the pants' legs, and then just roll up each leg panel 21 of the pants 20 upwardly towards the pocket 12, as shown in FIG. 3*a*. When rolled up, the pants 20 are lodged between the inner and outer skirts 16 and 14, and the zipper 18 is closed and the snaps 19 are engaged for closing the internal pocket 12 sufficiently to retain the pants 20 thereinside, As an alternative to the method for storing the pants 20 shown in FIGS. 3*a* and 3*b*, one may hold the jacket 20 from a lower corner 28 thereof, located adjacent to where the zipper 18 begins, such that the lower end 13 of the jacket hangs substantially vertically downwards with the panels 21 of the pants 20 which hang from the jacket 20 being deployed substantially as in FIG. 2; thereafter, the user zips up towards the ground a portion of the zipper 18 and thus partially forms the inside pocket 12, and then stuffs the closest part of the pants 20 into the soformed partial pouch, and continues closing the zipper 18 away from the corner 28 in a gradual manner such that the remainder of the pants 20 gradually becomes received in the pocket 12 as it is being gradually closed by the zipper 16. This method distributes the pants 20 substantially uniformly along and in the pocket 12 while being simpler, quicker and easier than the storing method proposed in FIGS. 3*a* and 3*b*.

In another embodiment of the present invention, similar to the above-described preferred embodiment, another all-in-one jacket and pants is disclosed. The pants may be held in two lateral pockets of the jacket having the opening toward the bottom, instead of being comprised in a single pocket.

It is noted that Velcro™ attachment strips may be used instead of the zippers 18 and 26 and instead of the snaps 19 and 24, and also that snaps may be used instead of the zippers 18 and 26. In fact, any detachable fastening system may be used. Furthermore, it is contemplated that the pants 20, instead of being permanently secured by seam 23 to the jacket 10 or outer skirt 14 at the level of the upper edge of the inner skirt 16, be detachably secured to the jacket 10, for instance to the outer skirt 14 and below the seam, connecting the inner skirt 16 to the outer skirt 14, e.g. below seam 23 of FIG. 23), by way of snaps, a zipper or Velcro™ attachment strips such as to permit the complete removal of the pants 20 from the jacket 10.

One great advantage of the present invention resides in the effortless manner in which the packable pants 20 are deployed from and packed up in the jacket 10. It is not required to take off the jacket 10 in order to deploy and assemble the pants into their functional position (as in the left leg of FIG. 1), thereby eliminating all of the effort that this action requires when the jacket must be removed to construct the pants and when the latter have to be slipped over shoes. The only action generally needed is to let the pants 20 drop down by unzipping the zipper 18 and then attaching them around the legs with zippers 26. The risk of dirtying the pants 20 by slipping them on over the shoes is eliminated Finally, the pants 20 are effortlessly carried by the person wearing the jacket 10 when they are in their stored position in the pocket 12.

What is claimed is:

1. A convertible garment, comprising jacket means and pants means attached at an upper end thereof to said jacket means, said pants means comprising a pair of flexible panel means each adapted to be reversibly displaced between open and closed positions thereof, wherein, in said closed position, each said panel means forms a hollow pant leg capable of surrounding a user's leg, wherein, when said panel means are in said open position, said panel means can be completely bundled up adjacent said upper end in a storage position of said pants means such that said garment only acts as a jacket, retention means being provided in said jacket means for retaining in said jacket said pants means in said storage position, whereby in said closed position of said panel means, said pants means act as pants for the user, wherein said retention means comprise elongated pocket means provided at a lower end of said jacket means for completely receiving said pants means in said storage position, and wherein said pocket means extend substantially along an entirety of said lower end of said jacket means such as to extend substantially completely around the user's waist, said pocket means defining a lower opening adapted to be selectively opened and closed for respectively allowing said pants means to be deployed from said jacket means and for retaining said pants means in said storage position.

2. A convertible garment as defined in claim 1, wherein said pocket means comprise front and rear panels defining said lower opening therebetween, detachable closure means provided at lower ends of said front and rear panels being selectively displaceable between open and closed positions, wherein in said closed position of said closure means, said pants means can be received and retained in said pocket means in said storage position, whereas in said open position of said closure means, said pants means can be deployed from said jacket means.

3. A convertible garment as defined in claim 2, wherein said front and rear panels are made of fabric and include inner and outer skirts sewn together along upper horizontal ends thereof, said pants means being sewn at said upper end thereof to said lower end of said jacket means.

4. A convertible garment as defined in claim 3, wherein said outer skirt is an integral portion of said lower end of said jacket means, said inner skirt being sewn on an inside surface of said lower end of said jacket means with an upper edge of said pants means being imprisoned thereat between said lower end of said jacket means and said inner skirt.

5. A convertible garment as defined in claim 2, wherein said closure means comprise zipper means extending substantially along lower edges of said front and rear panels.

6. A convertible garment as defined in claim 5, wherein said closure means further comprise detachable fasteners at longitudinal ends of said pocket means.

7. A convertible garment, comprising jacket means and pants means attached at an upper end thereof to said jacket means, said pants means comprising a pair of flexible panel means each adapted to be reversibly displaced between open and closed positions thereof, wherein, in said closed position, each said panel means forms a hollow pant leg capable of surrounding a user's leg, wherein, when said panel means are in said open position, said panel means can be completely bundled up adjacent said upper end in a storage position of said pants means such that said garment only acts as a jacket, retention means being provided in said jacket means for retaining in said jacket said pants means in said storage position, whereby in said closed position of said panel means, said pants means act as pants for the user, wherein said panel means of said pants means form a continuous pelvic panel at upper portions thereof while being separate from one another therebelow such as to respectively form in said closed position an upper pant section extending substantially between the user's waist and crotch and a lower pant section comprises a pair of pant legs.

8. A convertible garment as defined in claim 7, wherein said pants means further comprise a flexible crotch extension provided as an upward continuation of inner edges of said pant legs, said crotch extension being adapted to extend, in said closed position of said pants means, upward between the user's legs and in front of the user's pelvis and to be attached at outer edges thereof to upper portions of outer edges of said panel means with said inner edges of said pant legs being attached to lower portions of said outer edges of said panel means.

9. A convertible garment as defined in claim 8, wherein said panel means and said crotch extension are made of fabric.

10. A convertible garment as defined in claim 8, wherein detachable fastening means are provided at said outer edges of said crotch extension, at said inner edges of said pant legs and at said outer edges of said panel means.

11. A convertible garment as defined in claim 10, wherein said fastening means comprise zipper means extending substantially from the user's pelvis downwardly to lower ends of said pant legs.

12. A convertible garment, comprising jacket means and flexible pants means attached at an upper end thereof to said jacket means, pocket means provided at a lower end of said jacket means, said pocket defining at least lower opening means adapted to adopt at least partly open and closed positions thereof such that said pants means may be introduced in said pocket means through said opening means in said open position and stored and retained in said pocket mean when said opening means is in said closed position, wherein when said pants means are stored, said garment only acts as a jacket for a user of said garment, whereas when said pants means are deployed from said pocket means, said pants means act as pants for the user.

13. A convertible garment as defined in claim 12, wherein said pants means comprise a pair of flexible panel means each adapted to be reversibly displaced between open and closed positions thereof, wherein, in said closed position, each said panel means forms a hollow pant leg capable of surrounding the user's leg, wherein, when said panel means are in said open position, said panel means can be completely bundled up adjacent said upper end and stored in a storage position of said pants means in said pocket means.

14. A convertible garment as defined in claim 13, wherein pocket means is elongated and extends substantially along an entirety of said lower end of said jacket means such as to extend substantially completely around the user's waist.

* * * * *